United States Patent [19]

Hala

[11] 4,021,989

[45] May 10, 1977

[54] ROTATABLY PIVOTAL STONE ANCHOR AND STONE ANCHOR CONSTRUCTION SYSTEM

[75] Inventor: Alfred A. Hala, Islip, N.Y.

[73] Assignee: Hohmann & Barnard, Inc., Hauppauge, N.Y.

[22] Filed: Jan. 27, 1976

[21] Appl. No.: 652,866

[52] U.S. Cl. ..... 52/713; 52/235; 52/378; 52/426; 52/562; 52/704

[51] Int. Cl.[2] ..... E04B 1/38

[58] Field of Search ..... 52/235, 378, 379, 426, 52/428, 562, 563, 564, 565, 568, 704, 712, 713, 714; 110/1 A; 248/311.1, 274, 295, 298, 315

[56] References Cited

UNITED STATES PATENTS

| | | | |
|---|---|---|---|
| 2,304,333 | 12/1942 | Bossi | 52/562 |
| 2,574,938 | 11/1951 | Sinner | 52/704 |
| 3,353,312 | 11/1967 | Storch | 52/713 |
| 3,450,427 | 6/1969 | Fischer | 52/378 |
| 3,535,846 | 10/1970 | Storch | 52/713 |
| 3,640,043 | 2/1972 | Querfeld et al. | 248/274 |
| 3,786,605 | 1/1974 | Winfrey | 52/378 |

FOREIGN PATENTS OR APPLICATIONS

| | | | |
|---|---|---|---|
| 640,894 | 1/1964 | Belgium | 52/379 |

*Primary Examiner*—J. Karl Bell
*Attorney, Agent, or Firm*—Philip D. Amins

[57] ABSTRACT

A rotatable stone anchor apparatus is provided having one end portion thereof capable of threaded engagement with the projecting threaded bolt end portion of a standard expansion type anchor disposed within the inner wythe of a wall construction. The other end portion of the stone anchor is provided with a threaded bore having a disc tie threadedly secured therein. The stone anchor is laterally adjustable by virtue of the threaded rotational movement of the disc anchor and is pivotally rotatably adjustable about the axis of said expansion type anchor to permit the disc tie to be selectively positionable within grooves formed in the sides of stone slabs which form the outer wythe of the wall construction.

21 Claims, 5 Drawing Figures

ROTATABLY PIVOTAL STONE ANCHOR AND STONE ANCHOR CONSTRUCTION SYSTEM

The present invention is directed to a new and novel stone anchor apparatus and to a new stone anchor construction system.

BACKGROUND OF THE INVENTION

Heretofore it has been cumbersome and difficult to secure stone outer wythe constructions to masonry back-ups and steel back-ups which comprise either the inner wythe or frame of a wall construction.

The basic problems previously encountered were to secure the stone in position and to thereafter secure the anchors to the stone, subsequent to the initial anchor securement with respect to the aforesaid inner wythe or frame construction.

SUMMARY OF THE INVENTION

Accordingly, it is the primary object of the present invention to provide a new and novel stone anchor apparatus.

It is another object of the present invention to provide a new and novel stone anchor construction system employing the stone anchor apparatus of the present invention.

It is a further object of the present invention to provide a stone anchor apparatus which is capable of lateral adjustment with respect to the inner wythe of a wall construction, and which is capable of pivotal movement about a vertical plane for simplifying the securement thereof to a stone slab forming part of the outer wythe of the wall construction.

It is still another object of the present invention to provide a stone anchor apparatus of the foregoing type which is capable of threaded securement with a bolt secured to the inner wythe of a wall construction and which is selectively rotatable and pivotal about the axis of said bolt.

It is yet a further object of the present invention to provide a stone anchor apparatus of the foregoing type having a disc tie portion which is capable of positional securement in side grooves formed either in the sides of top or bottom edges of stone slabs employed to fabricate the outer wythe of the wall construction.

It is still a further object of the present invention to provide a stone anchor construction system employing expansion type anchor bolts and wherein one end portion of the stone anchors are positionally secured with respect to said anchor bolts.

BRIEF DESCRIPTION OF THE DRAWINGS

The foregoing and other objects, features and advantages of the present invention will become more apparent to those skilled in the art, from the detailed description hereinafter considered in conjunction with the accompanying drawings, wherein.

DETAILED DESCRIPTION OF THE PREFERRED EMBODIMENTS

Figure 2:
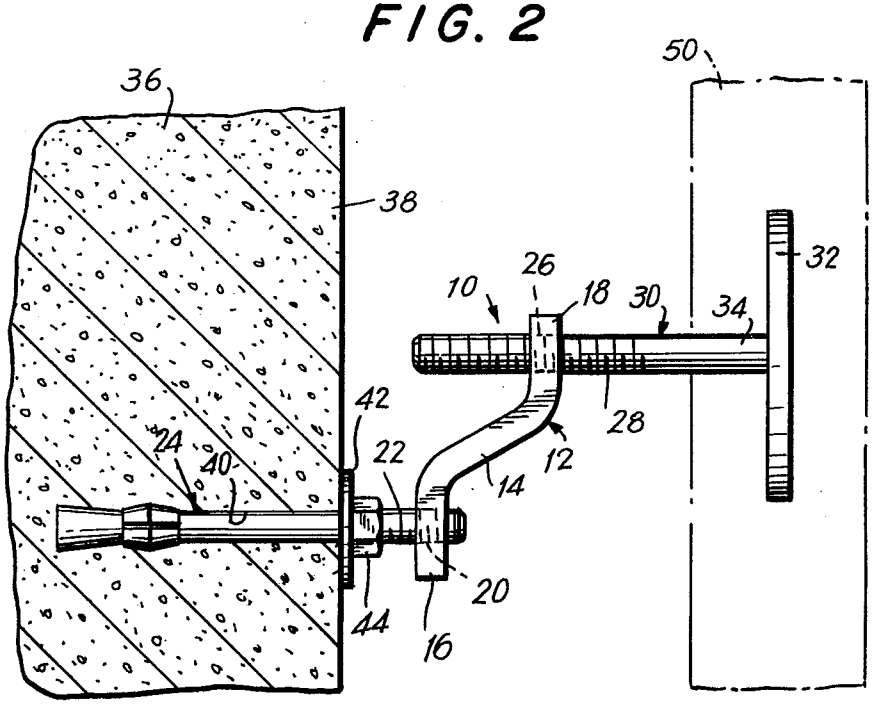
FIG. 2 is a partial sectional view in elevation of the stone anchor construction system depicted in FIG. 1.
Figure 1:
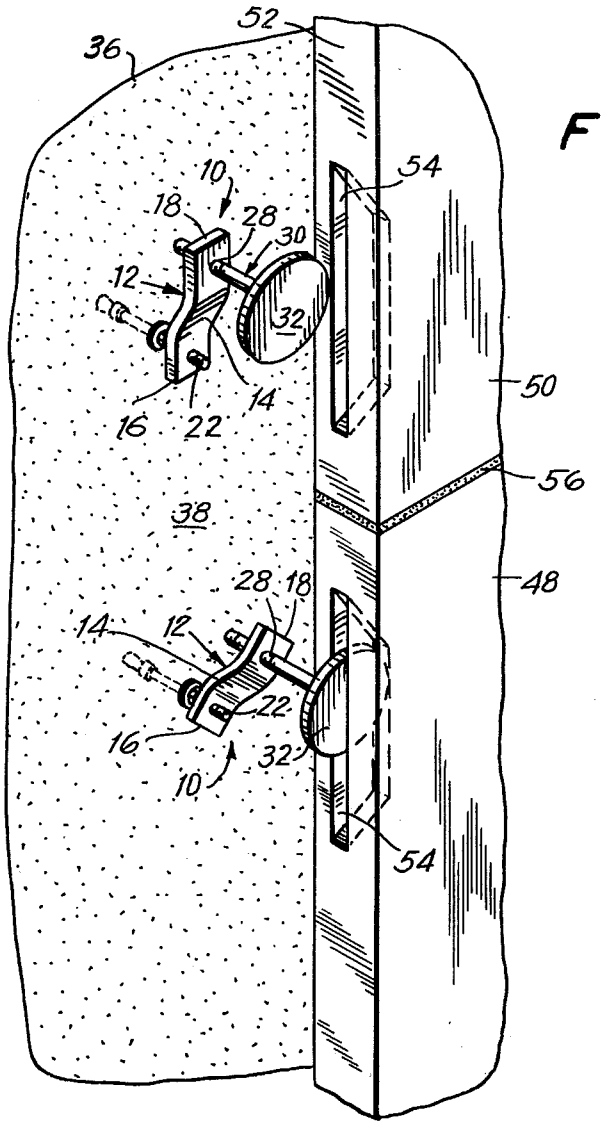
FIG. 1 is a partial perspective view depicting the new stone anchor construction system and a first embodiment of the rotatably pivotal stone anchor apparatus of the present invention.

Referring now to FIGS. 1 and 2, there is depicted a first embodiment of a stone anchor construction system employing a first embodiment of the rotatably pivotal stone anchor, generally denoted by the reference numeral 10 and constructed pursuant to and in accordance with the principles of the present invention.

The anchor comprises a pivotal arm member 12 having a substantially inverted S-type configuration as best seen in FIG. 2. The pivotal arm member 12 comprises a central portion 14, a first end portion 16 and a second end portion 18, with the end portions 16 and 18 being disposed in coplanar relationship with respect to one another and in lateral offset relationship with the central portion 14. The end portion 16 is provided with a threaded bore 20 which threadedly engages the threaded bolt 22 of an expansion type wedge anchor 24, as will be discussed in more detail hereinafter. The other end portion 18 is provided with a threaded bore 26 which threadedly engages the threaded bolt 28 of a disc tie, generally denoted 30 and which also includes a circular disc 32 secured to the distal end 34 of the bolt 28, either by being formed integrally therewith or welded thereto. However, it will be apparent that the disc 32 may be of rectangular, square or other suitably similar configuration.

The stone anchor construction system comprises a masonry back-up 36 which comprises an inner wythe and which may be formed of concrete, as denoted by the reference numeral 38. However, it will be apparent to those skilled in the art and it is herein specifically recited for the purpose of the present invention, that the term "inner wythe" as herein utilized is intended to encompass any suitable construction whether masonry or steel. In this regard, it is to be noted that the masonry back-up 36 may be concrete, cinder block, brick or any other suitable masonry structure. In a similar fashion, in some applications, the inner wythe may take the form of the steel framework of an edifice. Having thus described the broad concepts envisioned by the term inner wythe, attention is now directed to the particular embodiment depicted in FIGS. 1 and 2.

The stone anchor construction system employing the concrete inner wythe 38 has lateral horizontal bores 40 drilled therein and the expansion anchors 24 are positionally inserted within the bores 40. Thereafter, a washer 42 and a securement nut 44 which are positioned upon the bolt 22 are employed to securely fasten the anchor 24 with respect to the concrete inner wythe 38. This is accomplished by merely tightening the nut 44 upon the bolt 22, thereby causing the anchor to spread and wedge itself within the bore 40 in a manner which is well known in the art. After the anchors 24 have been securely positioned, as discussed hereinabove, the end 16 of the stone anchor 10 is secured with respect to the bolt 22 by threadedly engaging the bolt 22 within the threaded bore 20 of end portion 16. In this configuration, it will be apparent that the arm member 12 is both completely rotatable and pivotal about the longitudinal axis of the bolt 22. Moreover, since the disc tie 30 is fixedly positioned within the other end portion 18, the disc tie 30 is capable of pivotal and rotational movement about the axis of the bolt 22.

Having thus described the preliminary steps in the fabrication of the stone anchor system herein, attention is now specifically directed to FIG. 1 from where it is seen that after a lower stone slab 48 has been set and secured with respect to the concrete inner wythe 38 by the stone anchor 10, the next upper one of the stone slabs, herein denoted 50, is set upon the lower slab 48. When this step is being performed, the upper disc 32 is rotatably pivoted to the left so as to positionally dispose the arm member 12 in a substantially vertical orientation, which is horizontally offset with respect to the edge 52 of the stone slab 50. The edge 52 is provided with a vertically disposed groove 54 into which the disc 32 is adapted to be inserted. However, before this can be accomplished, the lateral projection of the disc tie 30 must be adjusted so as to properly align the disc 32 with respect to the groove 54. Since the bolt 28 of the disc tie 30 is threadedly engaged within the bore 26 of the end portion 18, rotational movement of bolt 28 causes inwardly or outwardly lateral adjustable movement of the disc tie 30, thereby enabling the same to be positionally disposed immediately adjacent the groove 54. Thereafter, the arm member 12 of the stone anchor is pivoted so as to place or seat the disc 32 within the groove 54, so that the final orientation is as that shown in conjunction with the disc 32 and the groove 54 for the stone slab 48. Of course, adjacent stone slabs such as 48 and 50 are provided with a mortar joint 56 therebetween.

It will thus be seen that the stone anchor construction of the present invention, which specifically employs the new and novel stone anchor apparatus 10, enables an artisan to easily and quickly secure the anchor with respect to the set slab in an extremely simple and expeditious manner, which is of course greatly aided by the fact that the anchor 10 was previously secured to the concrete inner wythe 38 and was capable of quick and easy displacement, prior to positional securement in its final orientation.

Figure 3:
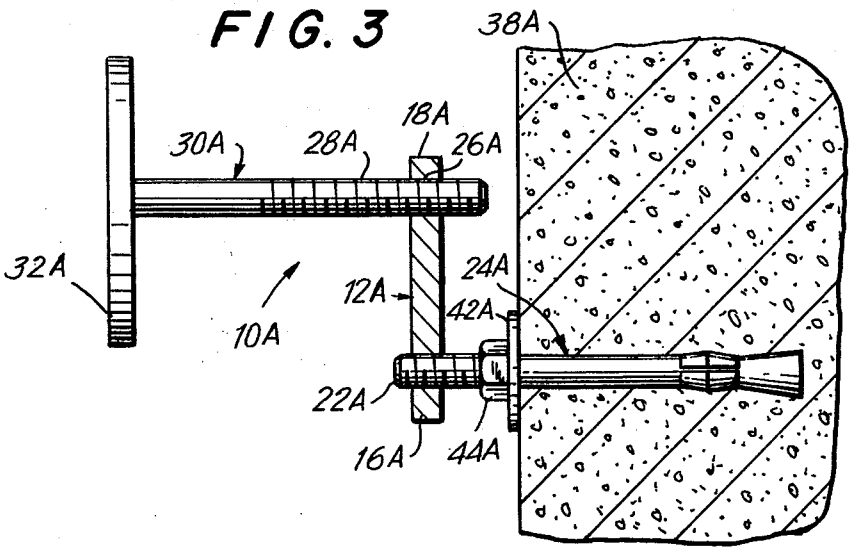
FIG. 3 depicts, in section, an elevational view of a second embodiment of a rotatably pivotal stone anchor constructed in accordance with the principles of the present invention.

Referring now to FIG. 3, there is depicted another embodiment of the stone anchor apparatus of the present invention wherein similar parts are denoted by similar reference numerals.

In this embodiment, the stone anchor apparatus 10A comprises a substantially planar pivotal arm member 12A having end portions 16A and 18A secured with respect to the threaded bolt 22A of an expansion anchor 24A in a manner described hereinabove in conjunction with FIGS. 1 and 2. The bolt 22A is secured with respect to the concrete inner wythe 38A by the securement nut 44A. Thus, the disc tie 30A is rotatably pivotal about the longitudinal axis of the threaded bolt 22A so as to permit the timely seating of the disc 32A, as previously discussed. The threaded engagement of threaded bolt 28A within bore 26A provides the lateral adjustability of the disc tie 30A.

Figure 4:
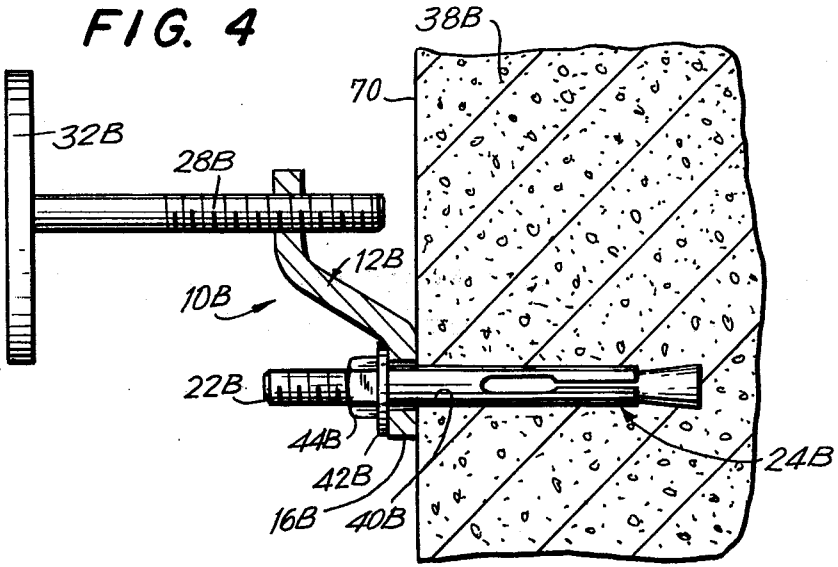
FIG. 4 is another sectional elevational view depicting the stone anchor apparatus comprising the first embodiment of the invention and utilized in a manner comprising a second embodiment of the stone anchor construction system of the present invention.

Referring now to FIG. 4, there is depicted another embodiment of the stone anchor construction system of the present invention, wherein similar parts are denoted by similar reference numerals. In the regard, the stone anchor 10B is of precisely the same structure and configuration as that discussed hereinabove in conjunction with FIGS. 1 and 2. However, in this embodiment, the arm member 12B is held in fixed immobile position by the securement nut 44B positioned upon the threaded bolt 22B, as will now be more fully discussed.

In the present embodiment, the anchor 24B is positioned within the bore 40B and the nut 44B and washer 42B are removed. Thereafter, the end 16B is placed upon the bolt 22B and the washer 42B and nut 44B secured upon bolt 22B. Subsequent tightening of nut 44B urges the end 16B into tangential abutting engagement with the back surface 70 of the inner wythe 38B, while concomitantly wedgingly securing the expansion bolt 24B within bore 40B. Thus, in the present embodiment, the arm 12B is immovable when nut 44B is completely tightened. However, if pivotal movement of the arm 12B is desired, the same can be accomplished by a slight loosening of the nut 44B, thereby enabling pivotal movement of the anchor 10B and desired placement thereof. After the anchor, and more particularly, the laterally adjustable disc 32B has been horizontally positioned in its final desired orientation, the nut 44B is then retightened, again rendering the arm 12B immobile.

Figure 5:
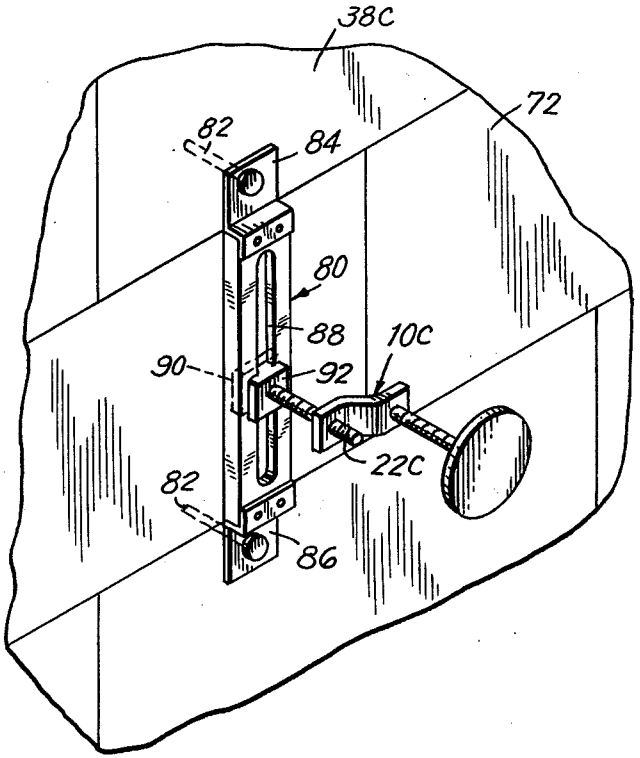
FIG. 5 depicts a partial perspective view of another embodiment of the stone anchor construction system of the present invention.

With reference now to FIG. 5, there is shown another embodiment of the stone anchor construction system of the present invention, wherein similar parts are denoted by similar reference numerals and employing a different securement apparatus with respect to the inner wythe 38C which is depicted as comprising a plurality of cinder blocks 72 secured together with respect to one another to form the inner wythe construction 38C. A slotted channel anchor, generally denoted by the reference numeral 80 is secured with respect to the inner wythe 38C by means of nails 82 projecting through the upper and lower tab edges 84 and 86 thereof, respectively. The channel anchor includes a vertically disposed slot 88 therein, and a bolt 22C is secured with respect to the anchor for vertical adjustable movement by means of a rear threaded nut 90 and a front threaded nut 92, both of which are herein depicted as being of rectangular and square configuration, but of course other shaped nuts may be employed equally as well.

In the present embodiment of the invention, the bolt is initially positioned and a stone anchor 10C is pivotally secured with respect to said bolt in the manner discussed hereinbefore. If vertical adjustment of the anchor 10C is necessitated, then the nut 92 is loosened and the bolt 22C having the anchor 10C threaded thereupon is moved either upwardly or downwardly to obtain the selected vertical positioning of the bolt 22C and thus of the stone anchor 10C. Thereafter, the nut 92 is then retightened for fixedly positioning the bolt 22C.

It will be appreciated that in the present embodiment, greater vertical adjustment is obtained than was possible in conjunction with the embodiments of the invention, as discussed in FIGS. 1 through 4 thereof. However, attention is directed to the fact that the various embodiments of the stone anchor herein are all capable of three-dimensional adjustability. This is occasioned by the fact that lateral adjustability is obtained by the lateral threaded adjustment of the disc tie 30, while both limited horizontal and lateral adjustability are obtained due to the rotational and pivotal movement of the arm 12 of the stone anchor 10. Moreover, further lateral adjustability can be obtained due to the inward and outward lateral positioning of the arm 12 which is occasioned by complete rotational revolutions of the arm 12 about the axis of the bolt 22, in those embodiments of the invention wherein the same is possible.

Although I have, in particular, shown a circular shaped disc configuration, the term "disc tie" and "disc", as employed, herein is intended to include similar and well known stone anchor structural configurations.

It will thus be seen that I have provided a new and novel stone anchor construction system and a plurality of new and novel stone anchor apparatuses which provide lateral, vertical and horizontal adjustablility and which will enable the craftsman setting and constructing the system to displace the anchor from its final setting while he is placing the stone slab in position and to thereafter place the anchor in its final determined and desired position to securely position and lock the stone slab in immovable relationship with respect to the inner wythe of the wall construction.

Attention is directed to the fact that while I have shown, described and discussed the various preferred embodiments of my invention, it will be apparent to those skilled in the art that there are various modifications, changes and improvements which may be made therein without departing from the spirit and scope of the invention, as herein envisioned and hereinafter claimed.

What is claimed is:

1. A stone anchor apparatus for interconnection between the inner wythe and the outer wythe of a wall construction, said stone anchor comprising
a central portion,
a first end portion, and
a second end portion, said first end portion being secured to said central portion and having a disc tie detachably secured thereto, said disc tie being capable of lateral adjustment with respect to said first end portion, said second end portion being secured to said central portion and having means capable of pivotal securement with respect to said inner wythe, said central portion and said first end portion being pivotally rotatable about said pivotal securement means of said second end portion for vertical and horizontal adjustability of said first end portion, and said disc tie having effective vertical, horizontal and lateral adjustability.

2. A stone anchor apparatus in accordance with claim 1, wherein said first end portion has a threaded bore formed therein, said disc tie comprising
a rod, and
a disc, means for securing one end of said rod to said disc, the other end of said rod being threaded, and said threaded bore receiving said threaded rod end portion in threaded engagement, whereby threaded rotational movement of said rod within said aperture provides lateral adjustability of said disc with respect to said first end portion.

3. A stone anchor apparatus in accordance with claim 2, wherein said rod and said disc are formed integrally with one another.

4. A stone anchor apparatus in accordance with claim 3, wherein said pivotal securement means of said second end portion comprises a threaded aperture formed therein.

5. A stone anchor apparatus in accordance with claim 1, wherein said central portion, said first end portion and said second end portion are disposed in substantially planar relationship.

6. A stone anchor apparatus in accordance with claim 5, wherein said central portion, said first end portion and said second end portion are formed integrally with one another.

7. A stone anchor apparatus in accordance with claim 1, wherein said first and second end portions are disposed in offset parallel relationship with respect to one another.

8. A wall construction system comprising an inner wythe and an outer wythe, a bolt member fixedly disposed with respect to said inner wythe, a stone anchor apparatus comprising
a central portion,
a first end portion, and
a second end portion, said first end portion being secured to said central portion and having a disc tie detachably secured thereto, said disc tie being capable of lateral adjustment with respect to said first end portion, said second end portion being secured to said central portion and having means for pivotally secureing the same with respect to said bolt member, said central portion and said first end portion being pivotally rotatable about the longitudinal axis of said bolt member for providing vertical and horizontal adjustability of said disc tie, said outer wythe comprising a stone slab having a groove formed in one of the side edges thereof, and said disc tie being capable of vertical, horizontal and lateral adjustability for selected predetermined placement thereof in the groove formed in said one of said edges of said stone slab.

9. A wall construction system is accordance with claim 8, wherein said bolt member has the longitudinal axis thereof disposed substantially normal to said inner wythe.

10. A wall construction system in accordance with claim 9, wherein said means for pivotally securing said second end portion to said bolt member comprises a threaded aperture formed therein, said bolt member being threaded and engageable within said threaded aperture, and rotational movement of said stone anchor apparatus about said threaded bolt member providing lateral adjustment of said stone anchor apparatus.

11. A wall construction system in accordance with claim 10, wherein said first end portion has a threaded bore formed therein, said disc tie comprising
a rod, and a disc, means for securing one end of said rod to said disc, the other end of said rod being threaded, and said threaded bore receiving said threaded rod end portion in threaded engagement, whereby threaded rotational movement of said rod within said aperture provides lateral adjustability of said disc with respect to said first end portion.

12. A wall construction system in accordance with claim 11, wherein said rod and said disc are formed integrally with one another.

13. A wall construction system in accordance with claim 10, wherein said central portion, said first end portion and said second end portion are disposed in substantially planar relationship.

14. A wall construction system in accordance with claim 13, wherein said central portion, said first end portion and said second end portion are formed integrally with one another.

15. A wall construction system in accordance with claim 10, wherein said first and second end portions are disposed in offset parallel relationship with respect to one another.

16. A wall construction system in accordance with claim 15, wherein said central portion, said first end portion and said second end portion are formed integrally with one another.

17. A wall construction system in accordance with claim 9, wherein said bolt member comprises part of an expansion anchor, said expansion anchor including a nut, and said nut being threadedly engageable upon said bolt member for wedgingly securing said expansion anchor within said inner wythe.

18. A wall construction system in accordance with claim 9, wherein said bolt member comprises part of a channel anchor, means for securing said channel anchor with respect to said inner wythe, said channel anchor including a slot formed therein, and means for releasably securing said bolt member within said slot to permit selective disposition of said bolt member therewithin.

19. A wall construction system is accordance with claim 18, wherein said slot has a vertical orientation.

20. A wall construction system in accordance with claim 19, wherein said releasable securement means comprises a pair of nuts threadedly engaging said bolt member, one of said nuts being disposed in juxtaposed position with a portion of the rear surface of said channel anchor surrounding said slot, and the other of said nuts being disposed in juxtaposed position with a portion of the front surface of said channel anchor surrounding said slot.

21. A wall construction system in accordance with claim 8, wherein said groove is formed in the side edge of said stone slab.

* * * * *